US006623233B2

(12) United States Patent
Peveling

(10) Patent No.: US 6,623,233 B2
(45) Date of Patent: Sep. 23, 2003

(54) METHOD AND APPARATUS FOR REMOVING BULK MATERIAL FROM A CONTAINER

(76) Inventor: Arthur Peveling, Heidsteigle 6/7, 74523 Schwaebisch Hall (DE)

( * ) Notice: Subject to any disclaimer, the term of this patent is extended or adjusted under 35 U.S.C. 154(b) by 0 days.

(21) Appl. No.: 10/108,376

(22) Filed: Mar. 29, 2002

(65) Prior Publication Data

US 2002/0154956 A1 Oct. 24, 2002

Related U.S. Application Data

(63) Continuation of application No. PCT/EP00/09701, filed on Oct. 4, 2000.

(30) Foreign Application Priority Data

Oct. 4, 2000 (EP) ..... 009701

(51) Int. Cl.[7] ..... B60P 1/00

(52) U.S. Cl. ..... 414/526; 414/507; 414/467; 406/43; 406/54; 406/138; 406/142

(58) Field of Search ..... 414/467, 507, 414/526; 406/43, 53, 54, 138, 141, 142

(56) References Cited

U.S. PATENT DOCUMENTS 2,573,269 A * 10/1951 Miller ..... 414/523
3,398,662 A * 8/1968 Takata et al. ..... 222/627
3,411,757 A * 11/1968 Hale ..... 366/28
3,482,721 A * 12/1969 Gleichman ..... 414/491
3,679,082 A 7/1972 Gramlich
4,502,820 A * 3/1985 Fujii et al. ..... 406/56
4,875,811 A 10/1989 Merrett et al.
5,199,826 A 4/1993 Lawrence
5,671,979 A * 9/1997 Poborsky ..... 298/17 R
5,713,494 A * 2/1998 Kaiju et al. ..... 222/199

FOREIGN PATENT DOCUMENTS

EP 0 713 473 B1 1/1998
GB 2 116 938 10/1983

* cited by examiner

*Primary Examiner*—Joseph A. Dillon
(74) *Attorney, Agent, or Firm*—Lawrence E. Laubscher, Sr.

(57) ABSTRACT

This invention relates to a system and a process for the removal of bulk material from a container, in particular, from a box-shaped transport container. In order to be able to suction the bulk material off in a simple and reliable manner out of the transport container, one first of all attaches to an outlet area of container (10) a removal instrument (23) that has a conveyance device. This conveyance device conveys the bulk material in the removal instrument (23) essentially against its direction of outflow out of container (10) into a discharge area of the removal instrument (23) out of which bulk material is sectioned off by means of an off-suctioning device (39) that is connected thereto. To support the off-suctioning of the bulk material, air—by means of an air supply device (17, 19, 20')—is so piped into the bulk material located in container (10) that the bulk material is fluidized.

27 Claims, 5 Drawing Sheets

METHOD AND APPARATUS FOR REMOVING BULK MATERIAL FROM A CONTAINER

REFERENCE TO RELATED APPLICATION

This application is a continuation of PCT application No. PCT/EP00/09701 of Oct. 4, 2000, which is based on the European Priority Application No. 99119620.5 filed Oct. 4, 1999.

This invention relates to a method and apparatus for removing bulk material from a container, in particular, a box-shaped transport container.

Bulk goods, especially sluggishly flowing bulk goods such as diatomaceous earth, silica gel or brewing gypsum that are used as filtration agent in essential foods production and as such, have a crystalline structure, are, after production; i.e., after burning and grinding, usually packaged in sacks as a fine powder and are delivered in this fashion from the producer to the consumer; i.e., to the essential foods producers such as breweries and the like.

The consumer then opens the sacks in specially provided devices in order to transfer the bulk goods into the silo container in which the bulk goods; i.e., the diatomaceous earth, silica gel or brewing gypsum, are kept and from which the particularly required quantity can be taken.

In the entire handling procedure of such dust-like or powdery bulk goods whose grain size is so small that the bulk goods dust can penetrate into the lungs of persons unhindered, one must watch out and make sure that no dust gets into the environment so as not to endanger the health of persons who handle and use such bulk material.

The European Patent No. EP 0 713 473 B 1 discloses a system, for removing sluggishly flowing, dusty bulk goods from silo containers for their storage where, attached to the outlet area of a silo container, there is a removal means that includes a conveyor device that is arranged coaxially with respect to the axis of the container in order to convey bulk goods from the lower area of a funnel—which is coaxial with respect to the container axis—upward against the force of gravity, in other words, essentially against the direction of flow of the bulk goods in the container to a discharge area. Connected to the discharge area is a bulk material auction device in order in a dosed manner to suction bulk goods rendered flowable as a result of the conveyance process.

It is furthermore already known that to transport sluggishly flowing bulk goods, one can use pressure tanks that can be impacted with compressed air amounting to several bar in order to fluidize the bulk goods, in other words, to make it flowable. To remove bulk goods from the pressure tank, one uses a suction device that works according to the Venturi principle and that is operated with compressed air.

Such pressure tanks, of course, are basically suitable for the transport of nonpourable or poorly flowing bulk goods, but they are extremely expensive because they must be able to withstand high pressures.

SUMMARY OF THE INVENTION

The object of the invention is to provide a system and a process for removing bulk goods from a container, in particular, from a box-shaped transport container that facilitates simple and reliable removal of sluggishly flowing bulk goods also after long transportation without the need for applying any high pressures.

According to the invention, the system for the removal of bulk goods from a container thus has an air supply device with the air for the fluidization of bulk material that can be directly introduced into the bulk material in the container. This makes it possible to take bulk material that has been heavily solidified by long transportation and to mix it with air in such a way, in other words, to fluidize it, that in conjunction with the discharge technique, it will continue to flow for proper discharge.

The following is particular important here: The air supply device must at least have a pipe with an air-permeable wall that can be connected to a pressure source and that can be attached in a container area that is located in front of the discharge area where the pipe with the air-permeable wall is made from a porous sinter material.

By using such a pipe, one can make it possible in a simple manner to conduct the air over a larger area immediately into the bulk material and to loosen the latter up from the inside and to fluidize it.

To make the pipe for injection into the bulk material sufficiently stiff, an advantageous version of the invention provides the following: The pipe with the air-permeable wall is arranged in an essentially cylindrical supporting frame made up of longitudinal and circumferential bridges whose longitudinal bridges essentially run in a spiral form around the pipe with air-permeable wall.

It is particularly practical when a borehole threading is arranged on the end of the pipe with the air-permeable wall that is to be arranged in the container. By combining the borehole threading with the spiral longitudinal bridges of the supporting frame, one can considerably simplify the insertion of the pipe for air supply into the bulk material.

To improve the fluidization of the bulk material in the area in front of the discharge area, a practical feature of the invention provides the following: The air supply device has a plurality of pipes with air-permeable walls where the several pipes, provided in each case in a supporting frame, are essentially equally long and can be attached mutually parallel in the container.

To facilitate the employment of the system for the removal of bulk goods, an advantageous development of the invention provides the following: Upon each pipe in the area of its end adjoining the compressed air source, there is attached a sleeve by means of which the pipe can be fastened in a holding sleeve that is provided on an adaptor frame which can be attached to the container where, on the adaptor frame, there is provided a collection pressure chamber that can be connected to the compressed air source and to which chamber one can connect each pipe with the air-permeable wall preferably by means of a pressure line.

A particularly preferred version of the invention is distinguished by the following: The container has a lining consisting of flexible, air-impermeable material in which the bulk material is received during a shipment in a manner protected against environmental factors.

By using an invention-based lining, one can essentially employ for the shipment of bulk goods, in particular, of sluggishly flowing bulk goods such as diatomaceous earth and the like, all conventional containers, in particular, also box-shaped transport containers such as, for example, maritime containers that are used for the shipment of the most varied types of goods on ships and trucks.

In order to protect the bulk material, on the one hand, during the shipment against moisture and the like and, on the other hand, to facilitate dust-free removal, an advantageous feature of the invention provides the following: The lining has an air supply area that can be cut up or cut out and that initially is tightly closed and in each case is surrounded by an outwardly extending flexible sealing cuff where the lining furthermore has an initially tightly closed discharge area for bulk material that can also be surrounded by an outwardly extending flexible sealing cuff and that can be cut up or cut out for opening.

The following is provided in order that—especially before and at the start of the removal of bulk material from the container—one can control the fluidization of the bulk material: The lining in an area remote from the discharge area for bulk material has an air outlet upon which adjoins an outwardly located hose whose free end can be tightly closed up.

In order further to facilitate the removal of bulk material and to avoid a so-called bridge formation where the bulk material is supported in an arch-like manner upon the sections of the container that surround the outlet area or the removal instrument, also a so-called chimney formation where the bulk material remains standing in lateral areas of the container, there is provided a particularly practical feature of the invention in that at least two removal instruments are provided which, both regarding the outflow direction of the bulk material and regarding the force of gravity, are arranged next to each other on the outlet area of the container.

Here it is particularly advantageous when each removal instrument has its own funnel segment in which is arranged the particular conveyance device with its conveyance device arranged essentially coaxially with respect to the funnel axis.

To facilitate the universal use of the invention-based system for the removal of bulk material, it is furthermore provided in a practical manner that each removal instrument can be attached to the container by means of an adaptor frame.

The invention-based process for the removal of bulk material from a transport container where a removal instrument is attached to an outlet area of the container in which bulk material in the removal instrument is essentially conveyed against its direction of outflow out of the container into a discharge area of the removal instrument and where bulk material is sectioned out of the discharge area is distinguished by the following features: Air is so piped into the bulk material in the container that the bulk material will be fluidized where preferably there are attached at least two removal instruments, both regarding the direction of outflow of the bulk material and with respect to the force of gravity next to each other on the outlet area of the container.

The following is provided in a particularly advantageous version of the invention-based process: Air can be supplied to the discharge area of the removal instrument via an adjustable secondary air valve in order to facilitate an independent off-sectioning current where the air, supplied via the secondary air valve, is reduced the moment the bulk material has been sufficiently fluidized in the container in order to increase the bulk material discharge.

In a practical manner, air for the purpose of fluidizing the bulk material is piped into the bulk material with the help of a pipe that has an air-permeable wall in a container area that lies in front of the outlet area.

In order to improve and render more uniform the fluidization of the bulk material, in other words, the loosening and whirling of bulk material with the supplied air, it is provided according to the invention that for the purpose of injecting air into the bulk material, one employs several pipes with air-permeable walls where the several pipes for the injection of air into the bulk material essentially are equally long and are arranged parallel to each other.

The following is provided here in a practical manner: The several pipes for injecting air into the bulk material are supplied with compressed air from a common compressed air source via a collection pressure chamber.

It is particularly advantageous when, prior to the start of the actual removal of bulk material from the container, air is piped into the container to fluidize the bulk material, whereas in an area remote from the outlet area of the container, air escapes from that portion where the air, escaping from the container, is filtered and is monitored for bulk material that is carried along.

BRIEF DESCRIPTION OF THE DRAWING

The invention will be explained in greater detail below with the help of the drawing.

Mutually corresponding parts are provided with the same reference symbols in the various figures shown in the drawing.

DETAILED DESCRIPTION

Although the invention-based system can be used for the removal of bulk material from a container basically when one deals with containers of the most varied shape, it can be employed in a particularly advantageous form in box-shaped transport containers and is therefore described below in conjunction with a so-called maritime container such as it is employed nowadays for the transport of the most varied goods by means of truck, rail and ship.

Figure 1:
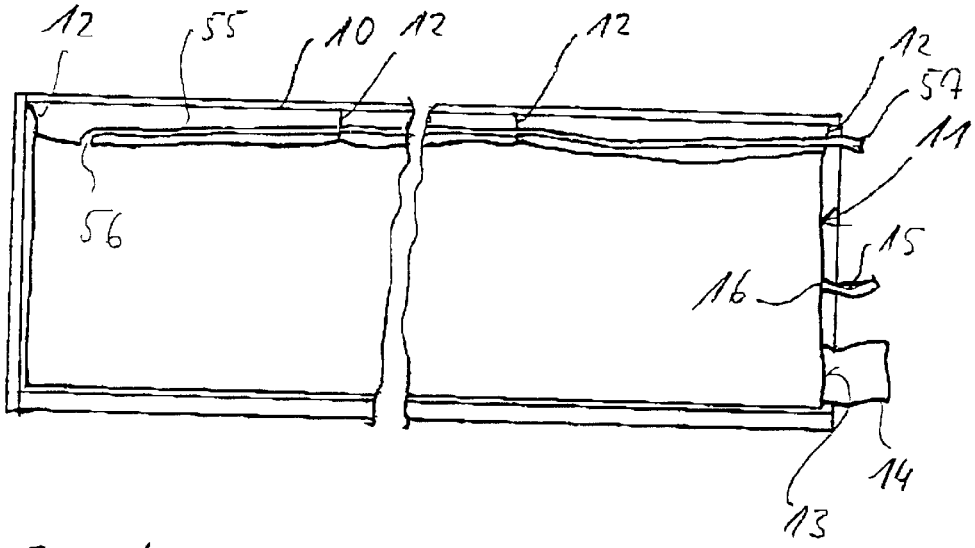
FIG. 1 is a schematic diagram showing a profile side view of a box-shaped transport container.

FIG. 1 is a diagram illustrating a box-shaped maritime container 10 that is provided with a lining 11. Lining 11 consists of an air-tight and moisture-tight, flexible material and is essentially so adapted to the box shape of the maritime container 10 that it covers the bottom and side walls and has a run that essentially runs parallel to the top of the maritime container as cover. In order to mount the lining in maritime container 10 according to the shape of maritime container 10 in the manner of a tent, there are provided loops 12 for suspending lining 11 in maritime container 10 of which only a few are indicated in the diagram.

Lining 11 has an outlet area 13 that, during the filling of maritime container 10 with bulk material and during shipment as such, is tightly closed and that is surrounded by an outwardly extending flexible sealing cuff 14. Sealing cuff 14 is here attached in an air-tight and watertight manner upon lining 11. Besides, outside upon lining 11 adjoining sealing cuff 14 of outlet area 13 in the area of a removable container rear wall, not shown, there are provided additional sealing cuffs 15 (of which only one is shown) that surround the air supply areas 16, which likewise are first of all tightly closed and that are opened only to unload the maritime container in order in each case to be able to insert a so-called air supply lance 17 (see FIGS. 2 and 4) into the interior of maritime container 10.

Figure 2:
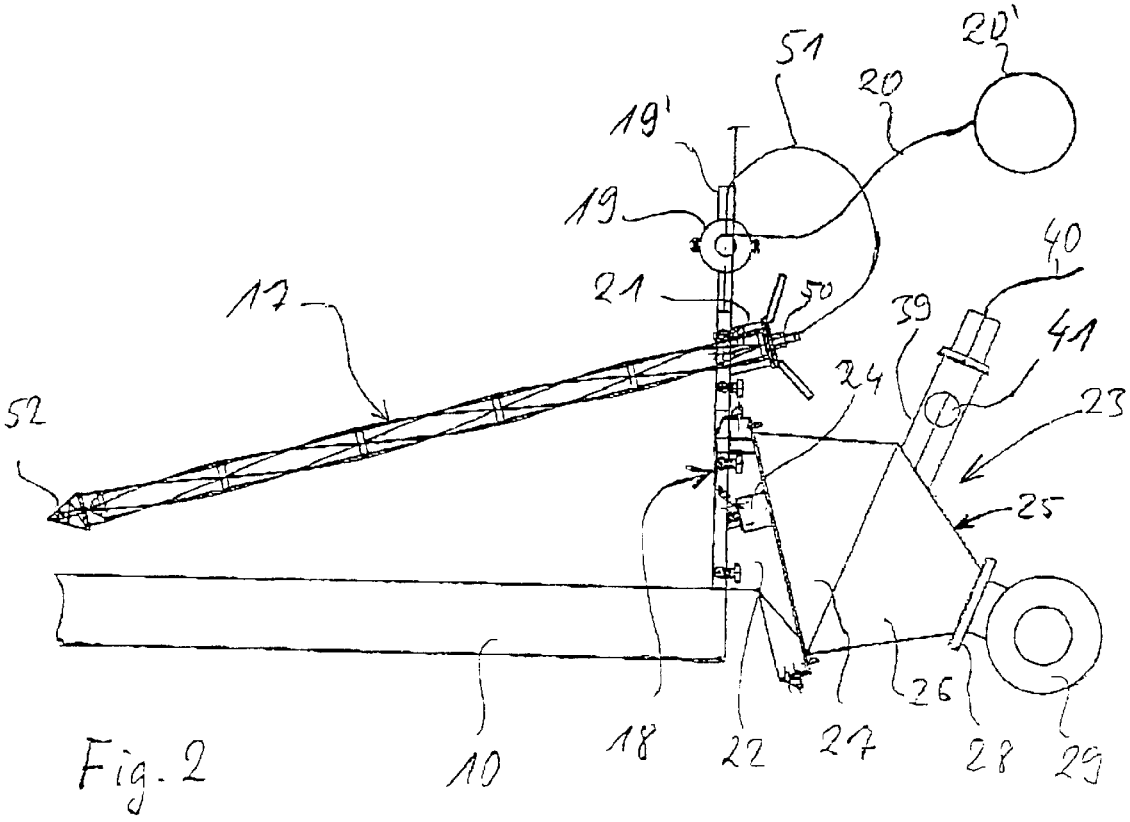
FIG. 2 is a schematic diagram showing a profile view of a section of a transport container with attached removal instrument and air supply device.
Figure 5:
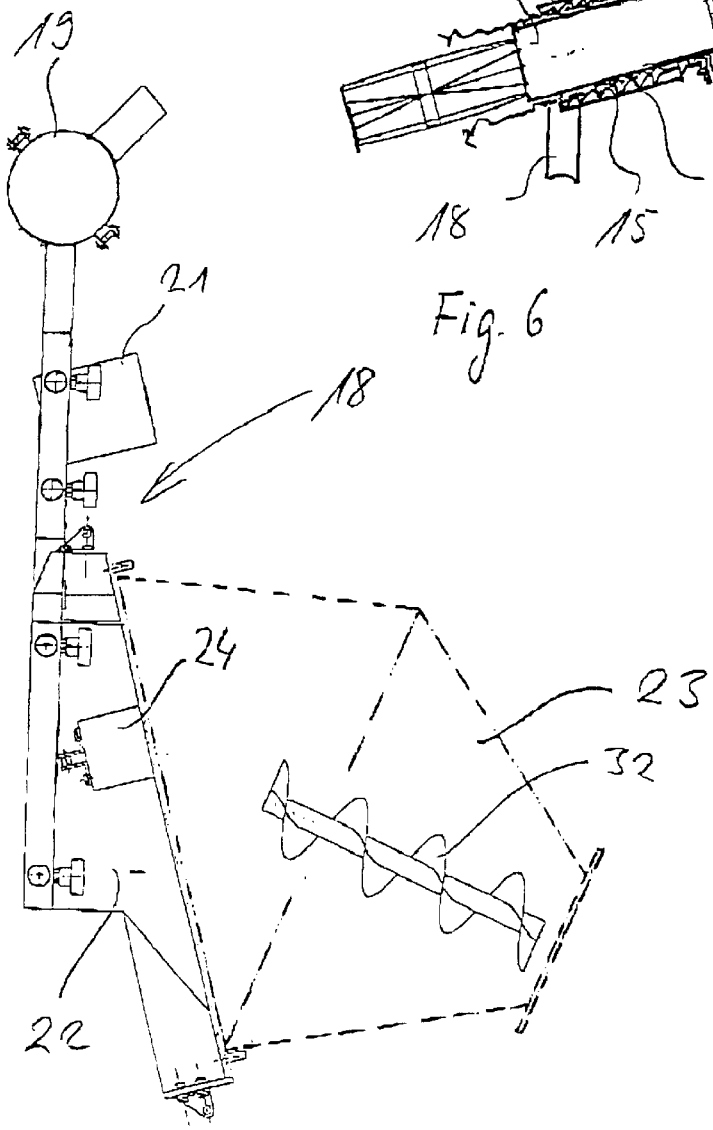
FIG. 5 is a schematic diagram illustrating a side view of an adaptor frame for the attachment of removal instruments and air supply device upon a box-shaped transport container.

FIG. 2 shows the corner in the lower right-hand corner in FIG. 1 of a maritime container 10 with removed rear wall upon which is attached an adaptor frame 18 in the lower area of the opening of maritime container 10 that is cleared by the rear wall. Attached to adaptor frame 18 that is shown enlarged in FIG. 5 is a collecting pressure chamber 19 which, via a compressed air line 20 that can be made as a compressed air hose, can be connected with a schematically indicated compressed air source 20'. Besides, arranged at an interval from each other on the adaptor frame 18 are several retaining sleeves 21 (see FIG. 7) to hold a plurality of air supply lances 17.

Furthermore, adaptor frame 18 has a connecting frame 22 upon which one can attach removal instruments 23. Fast closing means 24 are provided to fasten the removal instruments 23 upon the connecting frame 22 of adaptor frame 18.

Figure 3:
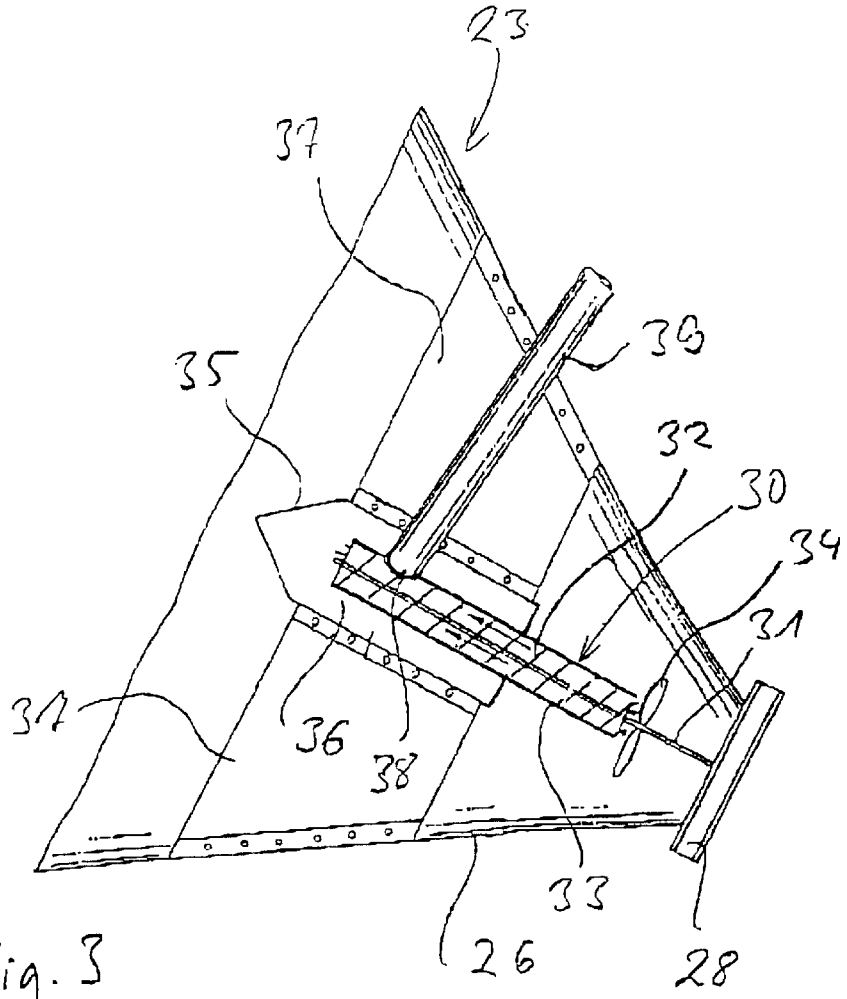
FIG. 3 is a schematic diagram showing a profile through a removal instrument employed according to the invention.

As illustrated in FIGS. 2 and 3, each of the removal instruments 23 has a housing 25 with a funnel segment 26 and a transition segment 27. A drive motor 29 for a conveyance drive 30 is attached to a bottom flange 28.

As illustrated in FIG. 3, the conveyance device 30 has a drive shaft 31 which, in a manner not shown in any greater detail, is driven via a gear by drive motor 29 and which is arranged coaxially with respect to the funnel axis of the funnel segment 26 of housing 25. Arranged upon drive shaft 31, for example, is a worm gear conveyor 32 that is surrounded by a conveyor pipe 33. The position of the conveyor device with relation to the funnel axis can be changed depending on the operating conditions, the bulk material that is to be conveyed and the position of the discharge area. But there is one thing that is important here: The direction of conveyance has an essential component running counter to the direction of outflow of bulk material out of maritime container 10.

When the conveyor device is in operation, the worm gear conveyor 32 conveys bulk material in the direction from the lower right-hand corner in FIG. 3 to the upper left-hand corner as indicated by the two arrows shown in conveyor pipe 33. Associated with the inlet-side end of conveyor pipe 33 can be a stirring device 34 that keeps the in-flowing bulk material in a fluidized, flowable condition and supplies it to conveyor pipe 33 or worm gear conveyor 32. The outlet side of conveyor pipe 33 is so surrounded by a cap 35 that there is formed a ring-shaped space 36 between cap 35 and conveyor pipe 33 through which bulk material that comes out of the conveyor pipe 33 on the outlet side can flow back to the inlet area. Cap 35 is retained in a suitable manner by several circumferentially distributed supports 37 in funnel segment 26 of housing 25 of removal instrument 23. The conveyor pipe 33 of conveyor device 30 can also be supported in cap 35 via supporting bridges or the like not shown in any greater detail.

Figure 4:
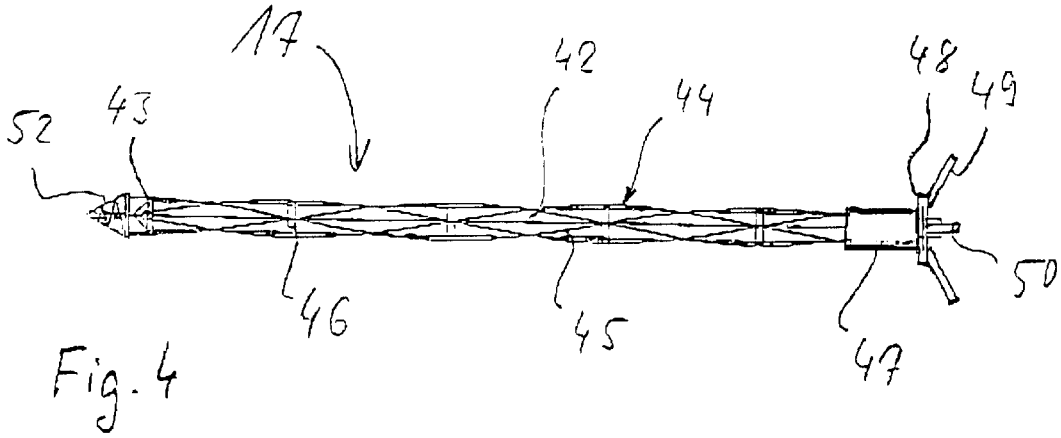
FIG. 4 is a schematic diagram illustrating a so-called air supply lance with a pipe having an air-permeable wall.

As shown in FIG. 4, the air supply lance 17 has a pipe 42 with air-permeable wall that is preferably made of a porous sinter material. On its front end, which is on the left in FIG. 4, pipe 42 is closed off with a cap 43 that can be made airtight or that can also be made of air-permeable sinter material. If pipe 42 is made sufficiently stiff, then it can be inserted immediately into the sinter material. But it is preferable when pipe 42, with the air-permeable wall, is arranged on a supporting frame 44 that, in particular, is made up of spiral longitudinal bridges 55 and circumferentially extending circumferential bridges 46. To fasten supporting frame 44 with pipe 42 arranged therein and having an air-permeable wall in one of the retaining sleeves 41, there is provided a sealing sleeve 47 on the right rear end of the air supply line 17 as shown in FIG. 4 upon which is attached a radial supporting flange 48 with handles 49. Attached to the supporting flange is also a connecting nozzle 50 for a compressed air supply line 51 (see FIG. 2).

As the air supply lance 47 [sic] is inserted, supporting frame 44 additionally separates the solidified bulk material and improves the penetration of air out of pipe 42 into the bulk material.

A borehole threading 52 is attached on the front end of the supporting frame to support the insertion of air supply lance 17 into the bulk material.

Figure 7:
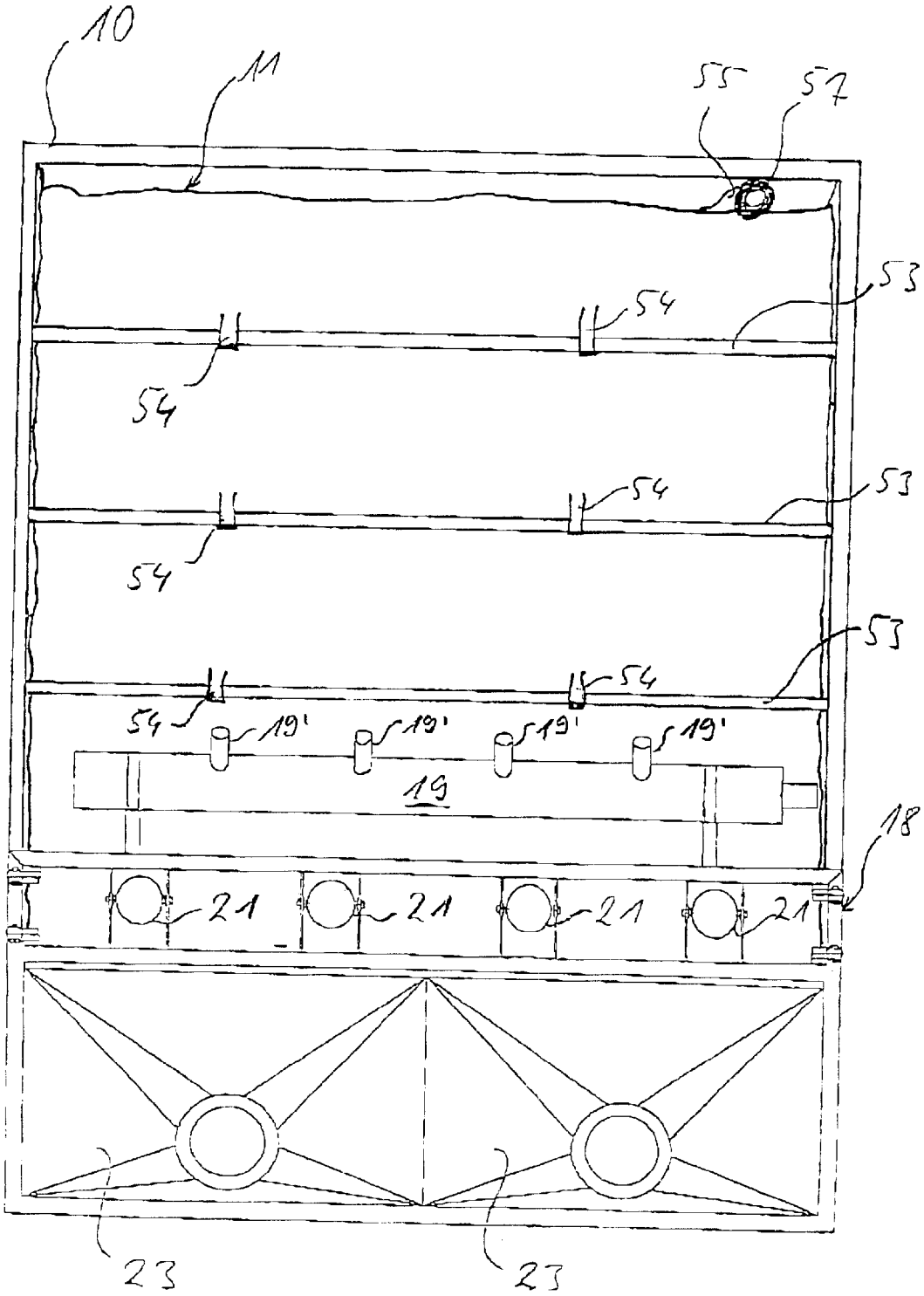
FIG. 7 is a schematic diagram illustrating a top view of an open side of a transport container, in particular, a so-called maritime container with adaptor frame attached to it.

As shown in FIG. 7, the box-shaped transport container, in other words, maritime container 10 in the area of the removal rear wall (door), has several spaced lateral struts upon which is retained the reverse run of lining 11 with the help of clips or loops 54.

As shown in FIGS. 1 and 7, a hose 55 is connected with an outlet opening 56 of lining 11 [and that hose] is extended from outlet opening 56 via the upper run of the lining and beyond into the area of the removable container rear wall or door. During shipment, the free end 57 of hose 55 is tightly closed up.

The handling and operation of the invention-based system for the removal of bulk material from a container is described below using the example of a maritime container 10.

After maritime container 10—which in the described manner is lined with a lining 11 and in which is held a poorly flowing bulk material, for example, diatomaceous earth—has arrived at the place of unloading, one first of all opens the rear wall or door of maritime container 10. Then adaptor frame 18 is attached to the frame of the rear opening or door of maritime container 10 as shown in FIG. 7.

After adaptor frame 18 has been attached upon maritime container 10, the sealing cuffs 15 of air supply areas 16 are drawn outward through retaining sleeves 21. In a corresponding manner, sealing cuff 14 of outlet area 13 is also drawn through connecting frame 22 for the removal instruments 23. Thereupon, one first of all attaches removal instruments 23. As shown in FIG. 7, two removal instruments 23 are arranged over the lower width of the rear opening of maritime container 10. But it is also conceivable, depending on the design of the removal instruments and the width of the container to be unloaded, that one might attach additional removal instruments so that they will be arranged next to each other with respect to the outflow direction of the bulk material out of the container and with respect to the force of gravity.

After the attachment of removal instruments 23, one can cut out the reverse run of lining 11. A corresponding hatch that can be closed tightly with a lid, not shown in any greater detail, is provided for this purpose in the transition segment 27 of housing 25 of the removal instruments 23.

Figure 6:
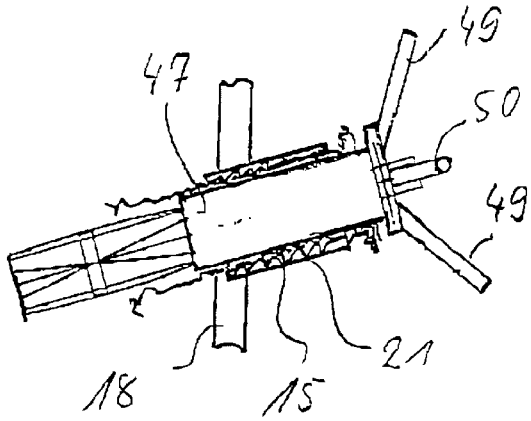
FIG. 6 is a diagram showing a partly cut-away view to explain the dust-type passage of an air supply lance through a lining provided in the container.

After removal instruments 23 have thus been attached to connecting frame 22 of adaptor frame 18 when the rear run has not yet been cut out in outlet area 13, there are attached to the air supply lances 17 compressed air lines 51 in order to connect the air supply lances 17 with connecting nozzles 19' of collecting pressure chamber 19. Then air supply lances 17 are impacted with compressed air and, as illustrated in FIG. 6, one after the other is guided through sealing cuffs 15 of air supply areas 18 and through retaining sleeves 21 upon adaptor frame 18. By means of boring threading 52, air supply lances 17 punch through the rear run of lining 11 and penetrate into the bulk material. In the process, each air supply lance 17 can by means of handles 49 or using a drilling machine or the like be rotated around its longitudinal axis so that the boring threading 52 will be screwed into the bulk material or will screw, whereby the bulk material is already loosened up and fluidized.

After shipment, the bulk material has become solidified in the container; therefore, to begin with, air continues to be piped into the bulk material located in the container so that it will be sufficiently fluidized. The air supply here takes place via the air-permeable walls of pipes 42 of air supply lances 17 that are inserted in an area into the bulk material that adjoins outlet area 13. While the compressed air that is under a low overpressure is piped into the bulk material through air supply lances 17, any excess air is evacuated through hose 55 out of lining 11. In order to prevent the leakage of dust-like bulk material into the environment, the free end 57 of hose 55 is attached to a suitable filter device that makes it possible at the same time to determine how much dust-like bulk material is carried by the air that is evacuated through hose 55. The share of bulk material that is carried along is used as an indicator here to determine just how much the bulk material has already been fluidized in the transport container.

During fluidization or after attainment of sufficient fluidization, the rear run of lining 11 is then cut out in the outlet area. Now one can also start up conveyance devices 30 of removal instruments 23 and one can turn on the off-sectioning devices 39. At that moment, the secondary air valves 41 are opened so that the air that is sectioned off via conveyor line 40 via off-sectioning device 39 will practically be completely the secondary air that is supplied via the secondary air valves 41. The system is now ready for the removal of bulk material from the maritime container.

The moment the bulk material in the transport container—in particular, adjacent to outlet area 13—has been fluidized sufficiently, bulk material will flow or slide as a result of the force of gravity into funnel segment 26 of housing 25 of removal instruments 23. There the bulk material is grasped by the worm gear conveyor 32 of conveyance device 30 and is conveyed in the direction toward discharge area 38. The flow of bulk material into the conveyor device is possibly supported here by stirring device 34. The bulk material, coming out of the upper end of conveyor pipe 33, flows through the ring-shaped space 36 back into the inlet area of conveyance device 30, as a result of which, there will be a bulk material circulation that sees to it that the bulk material remains in a state that is sufficiently fluidized for being sectioned off.

Now, via adjustment secondary air valve 41, the secondary air supply is choked back so that bulk material by means of conducting air is sectioned out of the container. One thus gets a pressure loss in removal instrument 23 by means of which air, conducting fluidized or dust-like bulk material, is sectioned out of the lining in the container into removal instrument 23 and is further sectioned off for the discharge of bulk material out of the transport container.

Depending on the already-reached degree of fluidization of bulk material, secondary air valve 41 can be more or less closed off in order thus to adapt the discharge performance of bulk material to the fluidization state of the bulk material in the container. In order to prevent a vacuum inside lining 11 at this moment, the air supply must be adapted to the air evacuation suction, in particular, when secondary air valve 41 is completely closed, the compressed air supply through air supply lances 17 must be practically equal to the air evacuation suction to remove bulk material.

Figure 8:
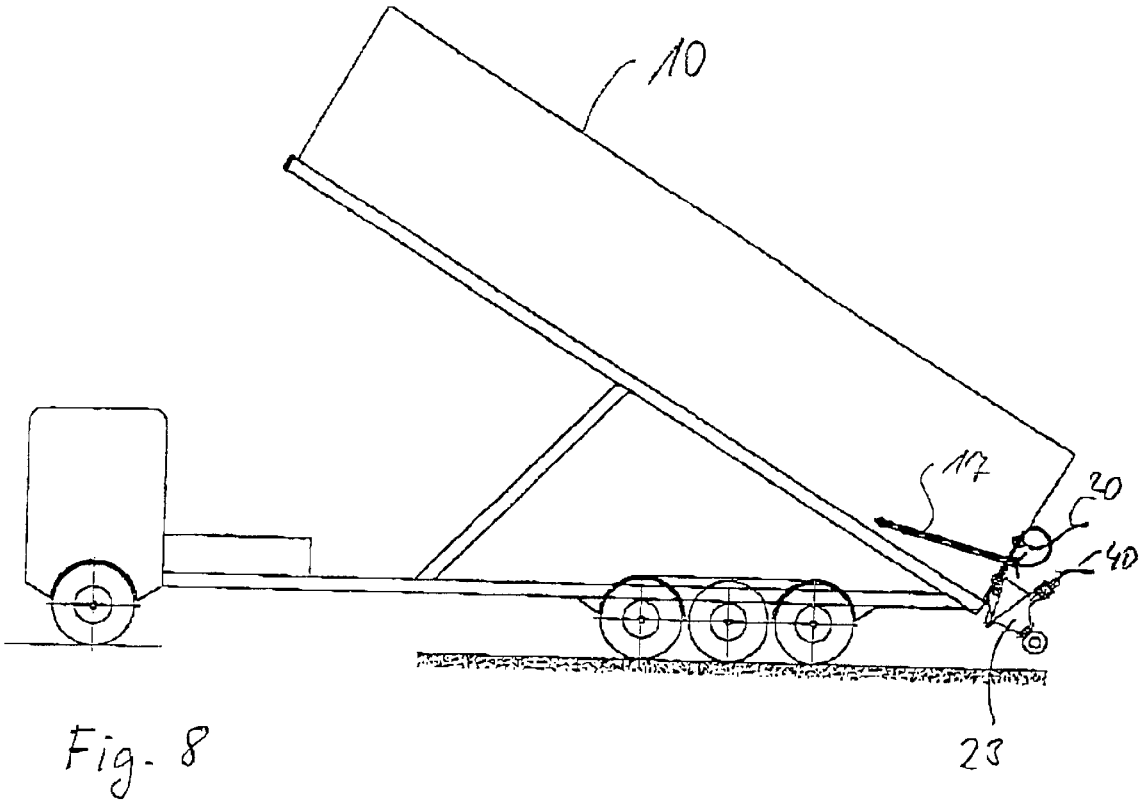
FIG. 8 is a simplified schematic diagram illustrating a side view of a transport container located on a truck during the removal of bulk material according to the invention-based process by means of removal instruments attached thereto and air supply device.

After the bulk material in the container has reached a sufficient fluidization state, the container that is to be unloaded, in other words, for example, maritime container 10 that is on a truck, is lifted into an oblique position shown in FIG. 8 in order to support the flow of bulk material to outlet area 13, in other words, to removal instruments 23. If in the process as yet not fluidized bulk material gets into the area of the air supply lances, then it is broken up against them and is fluidized by the penetrating air.

Air supply lances 17 that are used for fluidization of bulk material and by means of which compressed air is piped directly into the bulk material are arranged parallel to each other in the described exemplary embodiment and penetrate equally deeply into the interior of the container. But it is also conceivable that, for example, the two outer air supply lances are made longer than the two inner ones and/or that they are pushed at a flatter angle into the bulk material in the interior of the container.

The invention at hand thus makes it possible to evacuate by suction any poorly flowing bulk material out of a transport container when the bulk material, as a result of shipment, has been very severely solidified because the bulk material is fluidized with the help of an additional air supply device in front of the outlet area of the container.

What is claimed is:

1. System adapted for the removal of bulk material from a box-shaped transport container comprising a removal instrument (23) that can be attached to an outlet area of said container (10) and that includes an internal conveyance device (30) adapted to convey bulk material in a direction opposite the flow of material out of said container instrument, said discharge area being adapted to connect to a discharge area (38) of the removal an off-suctioning device (39), characterized in said that there is provided an air supply device (17, 19, 20') for piping air into the bulk material in said container (10) for purposes of fluidization.

2. System according to claim 1, characterized in that each removal instrument (230 can be attached to container (10) by means of an adaptor frame (18).

3. System according to claim 1, characterized in that at least two removal instruments (23) are provided which are attached next to each other upon the outlet area of container (10).

4. System according to claim 3, characterized in that each removal instrument (23) as its own funnel segment (26) in which is arranged the particular conveyance device (30) with its conveyance device placed essentially coaxially with respect to the funnel axis.

5. System according to claim 1, characterized in that container (10) has a lining (11) consisting of flexible air-impermeable material in which the bulk material is receiving during shipment in a manner protected against environmental factors.

6. System according to claim 5, characterized in that lining (11) has an air supply area (16) that ran be cut up or cut out, surrounded by a flexible sealing cuff (15) that is initially tightly closed and that in each case extends outward.

7. System according to claim 5, characterized in that lining (11) has an initially tightly closed outlet area (13) for bulk material that is surrounded by an outwardly extending flexible sealing cuff (14) and that can be cut up or out for opening purposes.

8. System according to claim 5, characterized in that the lining in an area remote from the outlet area (13) for bulk material has an air outlet (56) upon which adjoins an outwardly located hose (55) whose free end (57) can be tightly closed.

9. System according to claim 1, characterized in that the air supply device (17, 19, 20') has at least one pipe (42) with air-permeable wall that can be connected to a pressure source and that can be attached in a container area that is located in front of the outlet area.

10. System according to claim 9, characterized in that pipe (42) with the air-permeable wall is made of a porous sinter material.

11. System according to claim 9, characterized in that pipe (42) with the air-permeable wall is arranged in an essentially cylindrical support frame (44) made of longitudinal and circumferential bridges (45 or 46) whose longitudinal bridges (45) essentially run around pipe (42) with the air-permeable wall in a spiral manner.

12. System according to claim 9, characterized in that borehole threading (52) is arranged on the end of pipe (42) with the air-permeable wall that is to be arranged in container (10).

13. System according to claim 9, characterized in that air supply device has a plurality of pipes (42) with air-permeable walls.

14. System according to claim 13, characterized in that the several pipes (42) provided in a supporting frame (44) are essentially equally long and can be attached mutually parallel in container (10).

15. System according to claim 9, characterized in that attached to each pipe (42) in the area of its end that can be connected to the compressed air source (201), there is a sleeve (47) by means of which pipe (42) can be fastened in at retaining sleeve (21) that is provided on an adaptor frame (18) that can be attached to container (10).

16. System according to claim 15, characterized in that on adaptor frame (18) there is provided a collecting pressure chamber (19) that be connected to the compressed air source (20') and to which one can connect each pipe (42) with the air-permeable wall, preferably by means of a pressure line (51).

17. Process for the removal of bulk material from a box-shaped transport container comprising:

attaching a removal instrument to an outlet area of said container;

removing the bulk material from the container into the removal instrument in a first direction;

conveying the bulk material in a second direction, opposite said first direction, via a conveyance device, internal of said removal instrument, to a discharge area;

suctioning off the bulk material at the discharge area;

fluidizing the bulk material in the container via piped air.

18. Process according to claim 17, characterized in that the air for fluidizing the bulk material is piped into the bulk material in a container area that is remote from the outlet area.

19. Process according to claim 17, characterized in that at least two removal instruments are attached next to each other on the outlet area of container (10).

20. Process according to claim 17, characterized in that prior to the actual removal of bulk material from container (10), air is piped into container (10) for the purpose of fluidizing the bulk material, whereas air escapes from that container in an area of container (10) that is remote from the outlet area.

21. Process according to claim 20, characterized in that the air escaping from container (10) is filtered and is monitored for any bulk material that is carried along.

22. Process according to claim 17, characterized in that air can be supplied to the discharge area (38) of removal instrument (2.3) via an adjustable secondary air valve (41) in order to facilitate an independent off-suctioning air current.

23. Process according to claim 22, characterized in that the air, supplied via the secondary air valve (41), is reduced the moment the bulk material in container (10) has been sufficiently fluidized in order to increase the bulk material discharge.

24. Process according to claim 17, characterized in that the air for fluidizing the bulk material is injected into the bulk material by means of a pipe (42) that has an air-permeable wall.

25. Process according to claim 24, characterized in that for the purpose of injecting air into the bulk material, one employs several pipes (42) with air-permeable walls.

26. Process according to claim 25, characterized in that the several pipes (42) for the purpose of injecting air into the bulk material are essentially equally long and are arranged parallel to each other.

27. Process according to claim 25, characterized in that the several pipes (42) for the purpose of injecting air into the bulk material are supplied with compressed air from a common compressed air source (20') via a collecting pressure chamber (19).

* * * * *